US007658218B2

(12) United States Patent
Lai

(10) Patent No.: US 7,658,218 B2
(45) **Date of Patent: *Feb. 9, 2010**

(54) WINDOW BLIND SYSTEM

(76) Inventor: Tony Lai, 19223 E. Colima Rd., #750, Rowland Heights, CA (US) 91748

( * ) Notice: Subject to any disclaimer, the term of this patent is extended or adjusted under 35 U.S.C. 154(b) by 373 days.

This patent is subject to a terminal disclaimer.

(21) Appl. No.: 11/629,042

(22) PCT Filed: Apr. 1, 2005

(86) PCT No.: PCT/US2005/011102

§ 371 (c)(1),
(2), (4) Date: Dec. 8, 2006

(87) PCT Pub. No.: WO2006/001870

PCT Pub. Date: Jan. 5, 2006

(65) Prior Publication Data

US 2008/0264575 A1 Oct. 30, 2008

(30) Foreign Application Priority Data

Jun. 15, 2004 (CN) ..... 2004 0 0471891

(51) Int. Cl.
*E06B 9/303* (2006.01)

(52) U.S. Cl. ..... 160/115; 160/168.1 R; 160/176.1 R

(58) Field of Classification Search ..... 160/115, 160/168.1 R, 172 R, 173 R, 178.3, 176.1 R, 160/177 R
See application file for complete search history.

(56) References Cited

U.S. PATENT DOCUMENTS

| | | | | |
|---|---|---|---|---|
| 6,648,048 | B2 * | 11/2003 | Lai | 160/115 |
| 6,845,802 | B1 * | 1/2005 | Anderson et al. | 160/115 |
| 7,100,664 | B2 * | 9/2006 | Hsu | 160/115 |
| 7,159,636 | B2 * | 1/2007 | Liang | 160/115 |
| 7,296,606 | B2 * | 11/2007 | Liang | 160/115 |
| 7,308,927 | B2 * | 12/2007 | Lai | 160/116 |
| 7,424,905 | B2 * | 9/2008 | Lai | 160/168.1 R |
| 7,451,798 | B2 * | 11/2008 | Lai | 160/116 |

* cited by examiner

*Primary Examiner*—David Purol
(74) *Attorney, Agent, or Firm*—Raymond Y. Chan; David and Raymond Patent Firm

(57) ABSTRACT

A window blind system includes a top traverse supporter adapted for affixing to a top beam of a ceiling, and two shading arrangements downwardly extended from the top traverse supporter The first shading arrangement includes a base member, a plurality of slats, a first hanging system for spacedly and suspendedly supporting the slats and for controlling a tilt angle of each of the slats, and a first operating system for selectively lifting up the base member towards the top traverse supporter and unlifting the base member to drop downwardly away from the top traverse supporter. The second shading arrangement includes a second hanging system suspendedly support a predetermined set of the slats, so that by lifting up the second hanging system, the predetermined set of the slats are capable of being lifted for selectively allowing a light of desirable intensity passing through.

10 Claims, 6 Drawing Sheets

WINDOW BLIND SYSTEM

FIELD OF THE PRESENT INVENTION

The present invention relates to hanging system of window blind, and more particularly, relates to a hanging system for providing a compound window blind system multiple shading effects.

BACKGROUND OF THE PRESENT INVENTION

Blind and the like such as drapes and portieres are commonly used for sheltering window, separating spaces, and etc., since they are easily maneuverable and aesthetically appealing. Most of the blind comprise a traverse supporter adapted to be affixed to a ceiling, a plurality of hanging nets downwardly extended from the traverse supporter, and a plurality of slats horizontally and suspendedly supported by the hanging nets respectively in such a manner that, by operating a pulley system, the slats could be shifted in a vertical movable manner, or individually rotated at the same time.

However, the blind has several drawbacks. When the blind is opened, sunlight would directly enter the window thus not only heating up the interior of a house but also unpleasing to people's eye. Furthermore, the user has no privacy at all because the interior of the house is easily viewed from outside when the blind is opened, so that people may merely close the blind for privacy and security or open the blind for enjoying the sunlight. On the other hand, when the blind is fully closed, it would block all the sunlight effectively. Then, people might alternatively turn on the light lamp in order to brighten up the house. Besides, when the blind is fully opened, the sunlight is allowed to enter the house through the slat gaps. However, the size of the slat gap is predetermined by the manufacturer so that the user could not make a change. In order to allow more sunlight passing through the blind, the slat gap must be enlarged intentionally such that the width of the slat must be increased correspondingly for covering up the widen slat gap when the blind is closed.

Since the conventional window blind bears serious drawbacks, the users have to make a decision between sunshine enjoyment and privacy protection. Based on this situation, an amended window blind, which is capable of providing multifunctional shading effects, have emerged into existence nowadays. This multifunctional window blind comprises two independent shading systems extended downwardly from the top traverse supporter, wherein two shading system comprises respective hanging arrangement for horizontally and rotationally supporting respective set of slats. Meanwhile, the two shading system are vertically disposed at the same time to provide an alternating design for creating multiple shading effects. This is to say, the alternating design ensures each slat supported by the first hanging arrangement of first shading system is positioned adjacent to a slat supported by the second hanging arrangement of second shading system. In other words, the user could independently adjust each set of two hanging arrangement to control the distance between first set of slats and second set of slats, thus controlling the blind gap. Therefore, the light capacity passing through the window blind could be adjusted according to the user's mind.

Ordinarily, the hanging arrangement of window blind comprises at least an elongated ladder-shaped hanging net having a plurality of grids into which a blind slat is inserted to be supported. The ladder-shaped hanging net comprises two longitudinal cords and a plurality of traverse cords spacedly connected the two longitudinal cords to form a plurality of identical grids between two longitudinal cords for supporting the blind slats. Here, in this multifunctional window blind, the distance between any two slats (respectively belong to the first and the second shading system) is as same as the distance between two slats of a conventional window blinds.

As a result, under the normal circumstance, this multifunctional window blind just looks like a conventional window blind. However, in case of either set of shading system is operated, this amended window blind is capable of allowing lights penetrate into the interior from a distance range from regular gap (distance between neighboring slats of conventional window blind) to a distance twice as large as the regular gap. This is to say, in order to allow light penetrate from a wider gap, the size of grids of this multifunctional window blind are designed to have a bigger size, preferably, twice as the size as conventional window blind.

However, this kind of amended duplex window blind is not compatible with standardized size of conventional window blinds. As mentioned above, the hanging net grids of this amended window blind are twice as the size of the grid units of conventional window blinds. In other words, in this multifunctional window blind, the hanging net grid of this kind of shading system has a doubled size in comparison with the hanging net grid of conventional window blinds.

In addition, this kind of multifunctional window blind requires vertically and simultaneously disposing two individually operated blind system together for ensuring that one set of blind slats must be adjacent to another set of blind slats belong to another shading system. This is unfortunate for those manufacturers as well as assembling workers since its assembling process is so cumbersome and laborious thus causing the production costs of this kind of multifunctional window blind rather high.

Conclusively, it is desirable to further amend this kind of multifunctional window blinds arrangement.

SUMMARY OF THE PRESENT INVENTION

A primary object of the present invention is to provide a window blind system which is capable of providing multiple shading effects.

Another object of the present invention is to provide a window blind system, which comprises at least two shading arrangement for cooperatively controlling one set of blind slats so as to selectively shade the intensity of sunlight entering into the interior room.

Another object of the present invention is to provide a window blind system which is capable of achieving all features of conventional blind such as easy operation, less expensive, sunlight softening, privacy protection, and aesthetical appearance. In other words, the present invention is an all-in-one window blinding system.

Another object of the present invention is to provide a window blind system, wherein no expensive and complicated structure is employed in the present invention in order to achieve the above mentioned objects. Therefore, the present invention successfully provides an economic and efficient solution for providing multiple shading effects.

Accordingly, in order to accomplish the above objects, the present invention provides a window blind system, which comprises a top traverse supporter adapted for affixing to a top beam of a ceiling, a first shading arrangement, and a second shading arrangement, wherein the first shading arrangement, which is downwardly extended from the top traverse supporter, comprises a base member, a plurality of slats, a first hanging system for spacedly and suspendedly supporting the slats horizontally between the top traverse supporter and the base member and for controlling a tilt angle of each of the slats, and a first operating system for selectively lifting up the base member towards the top traverse supporter and unlifting the base member to drop downwardly away from the top traverse supporter, wherein the second shading arrangement, which is downwardly extended from the top traverse supporter, comprises a second hanging system for spacedly and suspendedly supporting a predetermined set of the slats horizontally between the top traverse supporter and the base member, a second operation system for lifting up the second hanging system towards the top traverse supporter, so that the predetermined set of the slats are capable of being lifted for selectively allowing a light of desirable intensity passing through from one side to another side of the window blind system.

Therefore, the user is able to selectively control the two shading arrangements to provide multiple shading effects.

These and other objectives, features, and advantages of the present invention will become apparent from the following detailed description, the accompanying drawings, and the appended claims.

DETAILED DESCRIPTION OF THE PREFERRED EMBODIMENT

Figure 1:
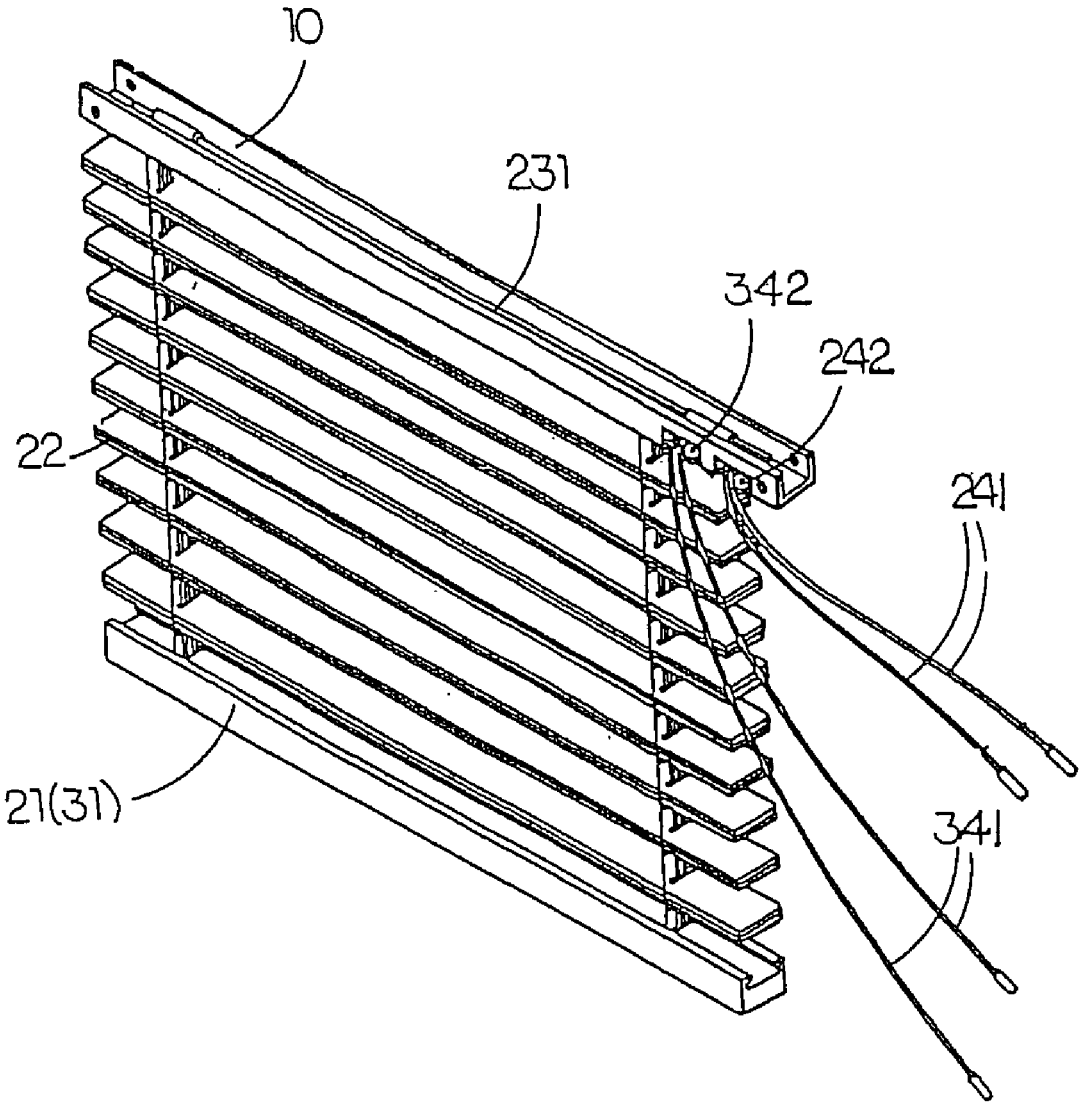
FIG. 1 is a perspective view of a window blind system according to a preferred embodiment of the present invention.
Figure 2:
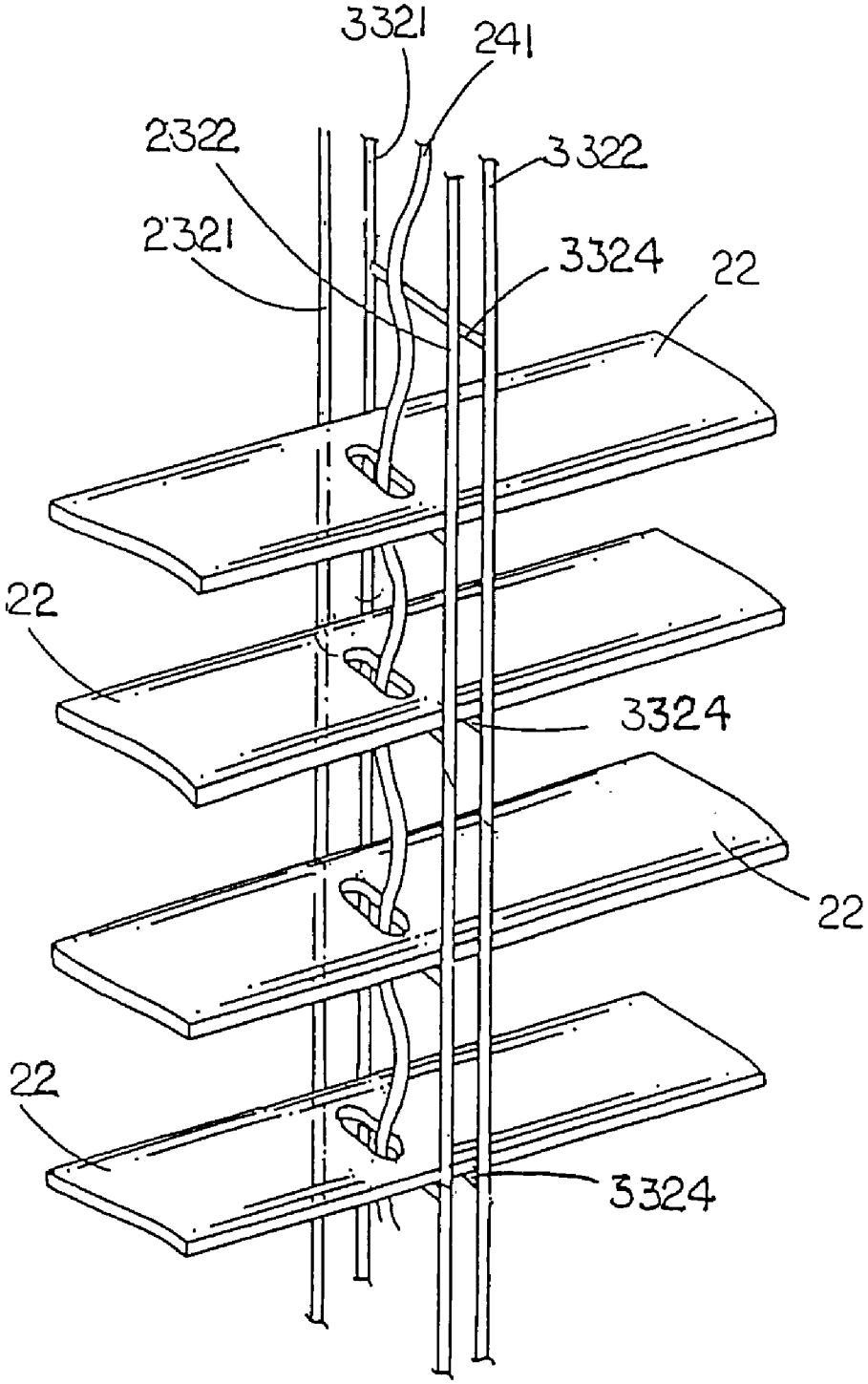
FIG. 2 is a partially perspective view of the window blind system according to the above preferred embodiment of the present invention illustrating the first hanging system and the second hanging system are commonly supporting the set of slats.
Figure 3:
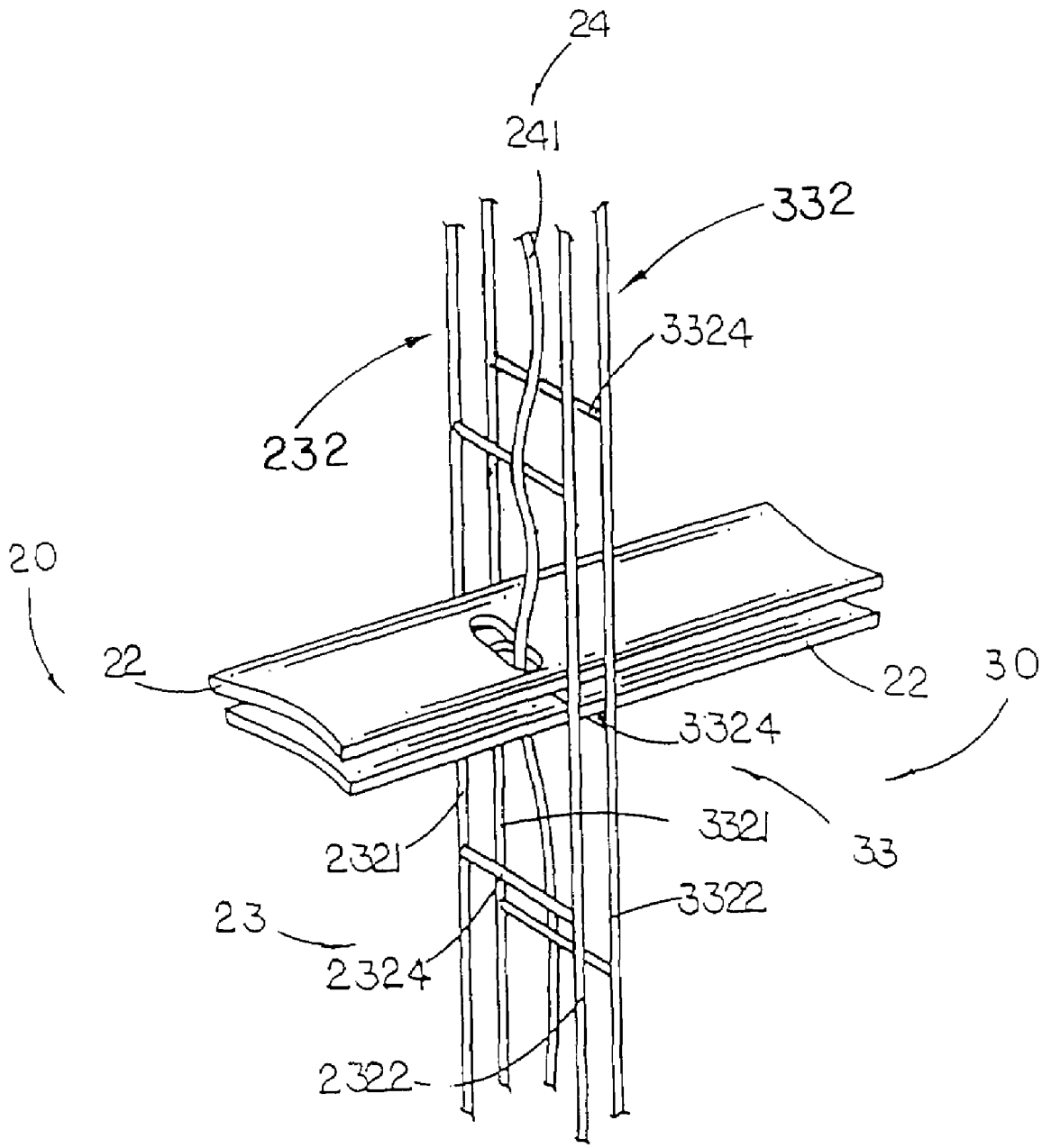
FIG. 3 is a partially perspective view of the window blind system according to the above preferred embodiment of the present invention illustrating after the second hanging system is lifted up, slats supported by the second hanging system are overlappedly adjacent to slats supported by the first hanging system.

Referring to FIGS. 1 through 3 of the drawings, a window blind system according to a preferred embodiment of the present invention is illustrated, wherein the window blind system comprises a top traverse supporter 10 adapted for affixing to a top beam of a ceiling, and two individually operated shading arrangement 20, 30 extended downwardly from the top traverse supporter 10. The first shading arrangement 20, which is downwardly extended from the top traverse supporter 10, comprises a base member 21, a plurality of slats 22, a first hanging system 23 which is adapted for spacedly and suspendedly supporting the slats 22 horizontally disposed between the top traverse supporter 10 and the base member 21 and for selectively rotating the angle of slats 22, and a first operating system 24 for selectively lifting up the base member 21 towards the top traverse supporter 10 and unlifting the base member 21 to drop downwardly away from the top traverse supporter 10. The second shading arrangement 30, which is downwardly extended from the top traverse supporter 10, comprises a second hanging system 33 which is adapted for spacedly and suspendedly supporting a predetermined set of the slats 22 horizontally disposed between the top traverse supporter 10 and the base member 21, and a second operating system 34 for lifting up the second hanging system 33 towards the top traverse supporter 10 and unlifting the second hanging system 33 to drop downwardly away from the top traverse supporter 10.

The first hanging system 23 comprises a traverse arm 231 rotatably mounted to the top traverse supporter 10, at least two elongated hanging nets 232 vertically extended from two ends of the traverse arm 231 for suspendedly supporting the slats 22 and the base member 21. Furthermore, the elongated hanging net 232 comprises a first and second supporting cords 2321, 2322 extended from two ends of the traverse arm 231 all the way to the base member 21, and a plurality of traverse cords 2324 are spacedly extended between the first supporting cord 2321 and the second supporting cord 2322 to form a plurality of vertically and consecutively arranged first hanging grids 2325, wherein the slats 22 are positioned between the first and second supporting cords 2321, 2322 and separated by the first hanging grids 2325. In other words, the elongated hanging net 232 is a ladder shaped hanging system, wherein each slat 22 is supported by an individual traverse cord 2324 and spacedly separated by the first hanging grids 2325 with a distance of the length of the grids 2325. As a result, the slats 22 can be rested and supported on the traverse cords 2324 respectively within the grid 2325. Furthermore, the tilt angle of the slats 22 can be controlled by rotating the traverse arm 231 to reversely lift up and drop down the first and second supporting cords 2321, 2322 at the same time. In other words, the first supporting cord 2321 and the second supporting cord 2322 are reversely moved in a vertical direction so that the rotation of the traverse arm 231 will lead to the variation of the tilt angle of the slat supported in the first grid 2325. Accordingly, the first and second supporting cords 2321, 2322 are preferred to be integrally formed in one-piece wherein lower ends of the first and second supporting cords 2321, 2322 are connected together to the base member 21. The first operating system 24 comprises a lift lock 242 rotatably mounted on the top traverse supporter 10 and a pair of lift cords 241 each having a first end portion extended to the base member 21. Each of the two lift cords 241 upwardly extends to penetrate through the slats 22 and then traversely extends through the top traverse supporter 10, wherein a second end portion of each of the lift cords 241 is extended out of the top traverse supporter 10 via the lift lock 242 to control the folding and unfolding of the first shading arrangement 20.

The second shading arrangement 30 is acted as a supplemental shading system for assisting the first shading system 20 to provide various shading effects. Here, the second hanging system 33 also comprises at least two elongated second hanging nets 332 vertically extended from two ends of the traverse arm 231 to the base member 21 for supporting a predetermined set of the slats 22. Accordingly, the predetermined set of slats 22 supported by the second hanging system 33 is lesser than the total number of the slats 22 supported by the first handing system 23. Moreover, the second hanging net 332 comprises a first and second supporting strings 3321 and 3322, and a plurality of traverse strings 3324 spacedly extended between the first and second supporting strings 3321, 3322 to form a plurality of vertically and consecutively arranged second hanging grids 3325, wherein portion of the slats 22 are positioned between the first and second supporting strings 3321, 3322 and supported by the second hanging grids 3325. The second operating system 34 comprises at least a pair of retaining cords 342 connected to the second hanging nets 332 for lifting up the second hanging system 30, and a retaining device 341 for holding the retaining cords 342. It is noted that the second supporting strings 3321, 3322 upwardly extend to a front and back side of the traverse arm 231 then the free end portions of the first and second supporting strings 3321, 3322 are merged together to form a retaining cord 342 coupled with a retaining device 341 in the present invention. Through the retaining device 341, the user is able to pull the retaining cord 342 and hold the second hanging system 33 in a lifted position. As a result, the vertical displacement of the second hanging system 33 is controllable thus ensuring the multiple shading effects of the window blinding system 1. Here, it is worth to mention that the retaining device could be embodied as an electrical device or a manual operable device.

According to the preferred embodiment, the first shading arrangement 20 and the second shading arrangement share one base member 21, and each of the slats 22 is unexceptionally supported by the first hanging grids 2325 of the first hanging system 23. At the same time, to ensure the window blind 1 are capable of fully blocking sunlight penetrating through, the height of each hanging grid 2325 is at least larger than the width of the each hanging grid 2325. That is to say that the distance between two adjacent traverse cords 2324 is shorter than the length of the traverse cord 2324 for ensuring the blocking effect. In the present invention, the shading effect of the first shading arrangement 20 has exactly the same shading function with conventional window blinds, and the second shading system 30 is applied as a supplemental arrangement for assisting the first shading system 20 to provide various shading effects.

In other words, a portion of the slats 22 are positioned between the first supporting string 3321 and the second supporting string 3322 and supported by both traverse cords 2324 and traverse strings 3324. As described before, the second hanging system 33 have similar structure in comparison with the first hanging system 23. Nevertheless, the difference is that the second hanging grids 3325 have different size in comparison with the first hanging grids 2325. According to the first preferred embodiment of the present invention, the length of the second hanging grids 3325 (i.e. the distance between adjacent traverse strings 3324) are longer than the length of the first hanging grids 2325, preferably, at least twice the length of the first hanging grids 2325 (the distance between adjacent traverse cords 2324) as shown in FIG. 2.

As shown in FIGS. 2 and 3, every single slat 22 is supported within the first hanging grid 2325 of the first hanging system. Meanwhile, since the length of the second hanging grids 3325 (i.e. the distance between adjacent traverse strings 3324) are at least twice the length of the first hanging grids 2325 (the distance between adjacent traverse cords 2324) in the preferred embodiment, the area size of each of the second hanging grid 3325 is twice as much as the area size of the first hanging grid 2325. In other words, the size of the second hanging grids 3325 equals to the size of two vertically connected first hanging grids. Therefore, the slats 22 are supported by the first hanging system 23 and second hanging system 33 simultaneously, only half set of slats 22 are supported by both traverse cords 2324 of the first hanging system 23 and traverse strings 3324 of the second hanging system 33 as shown in FIG. 2. Accordingly, another half set of slats 22 are only supported by traverse cords 2324 of the first hanging net 232. This is to say every other slat 22 is supported by both first hanging net 232 and second hanging net 332. For instance, if the slats are divided into two sets, namely, even numbered slats and odd numbered slats, only one set of the slats 22 are supported by both hanging nets. As a result, if the second hanging net 332 are lifted by the retaining cord 342, half set of slats 22 supported by second hanging nets 332 will be lifted until such half set of slats overlappedly contact with another set of slats 22 which are not supported by the second hanging net 332. Since every two adjacent slats 22 are overlapped, sunlight are allowed through from a gap twice as the size of conventional gap 222 as shown in FIG. 3.

Conclusively, the slats 22 of the first shading arrangement 20 are supported by both the first hanging system 23 and second hanging system 33. The second hanging system 33 is functioned as an auxiliary means for only supporting a portion of the slats 22. In the preferred embodiment, every single slat 22 not supported by the second hanging system 33 must be adjacent to a slat 22 supported by the second hanging system 33. So, the slats 22 not supported by the second hanging system 23 and slats 22 supported by the second hanging system 33 are vertically disposed from the top traverse supporter 10 to the base member 21 in a crossed cyclic manner, every other slats 22 belong to one set.

Figure 4:
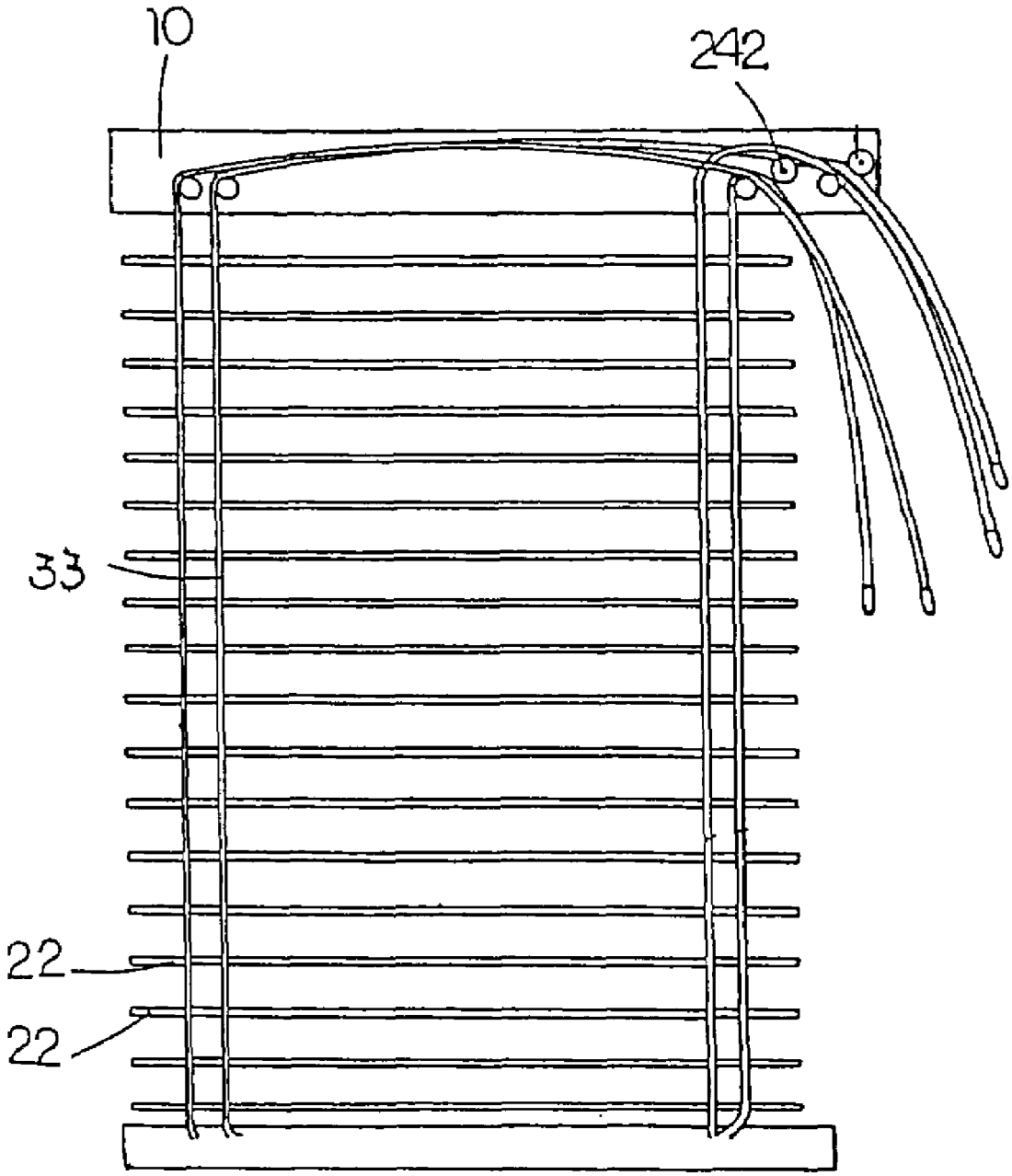
FIG. 4 is a schematic view of the window blind system according to the above preferred embodiment of the present invention, illustrating when the second hanging system is not lifted, the shading effect of the window blinding system are same as the conventional window blinds.
Figure 5:
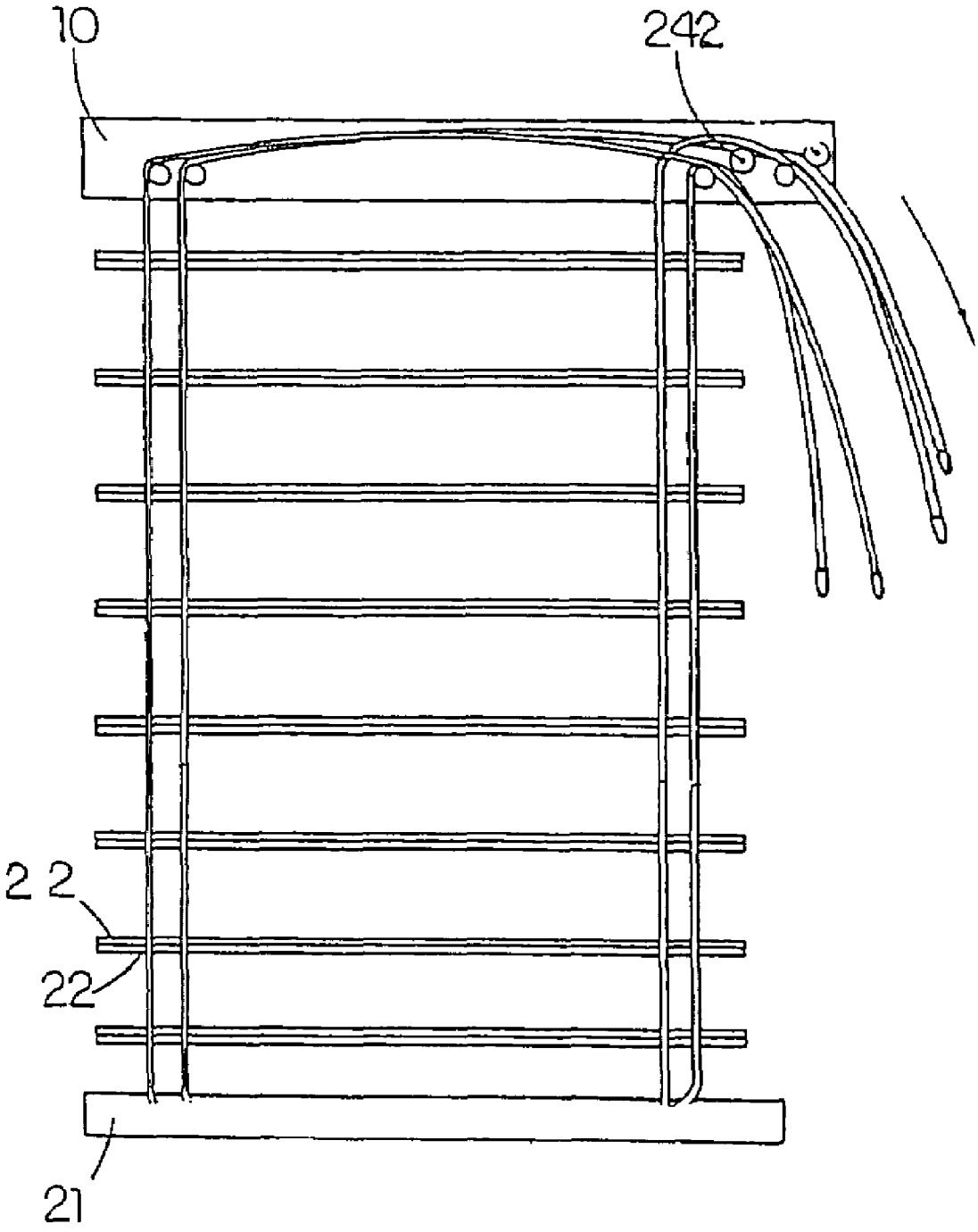
FIG. 5 is a schematic view of the window blind system according to the above preferred embodiment of the present invention, illustrating when the second hanging system is lifted, the light are able to pass through the window blind in a gap twice as the size of the conventional window blinds.
Figure 6:
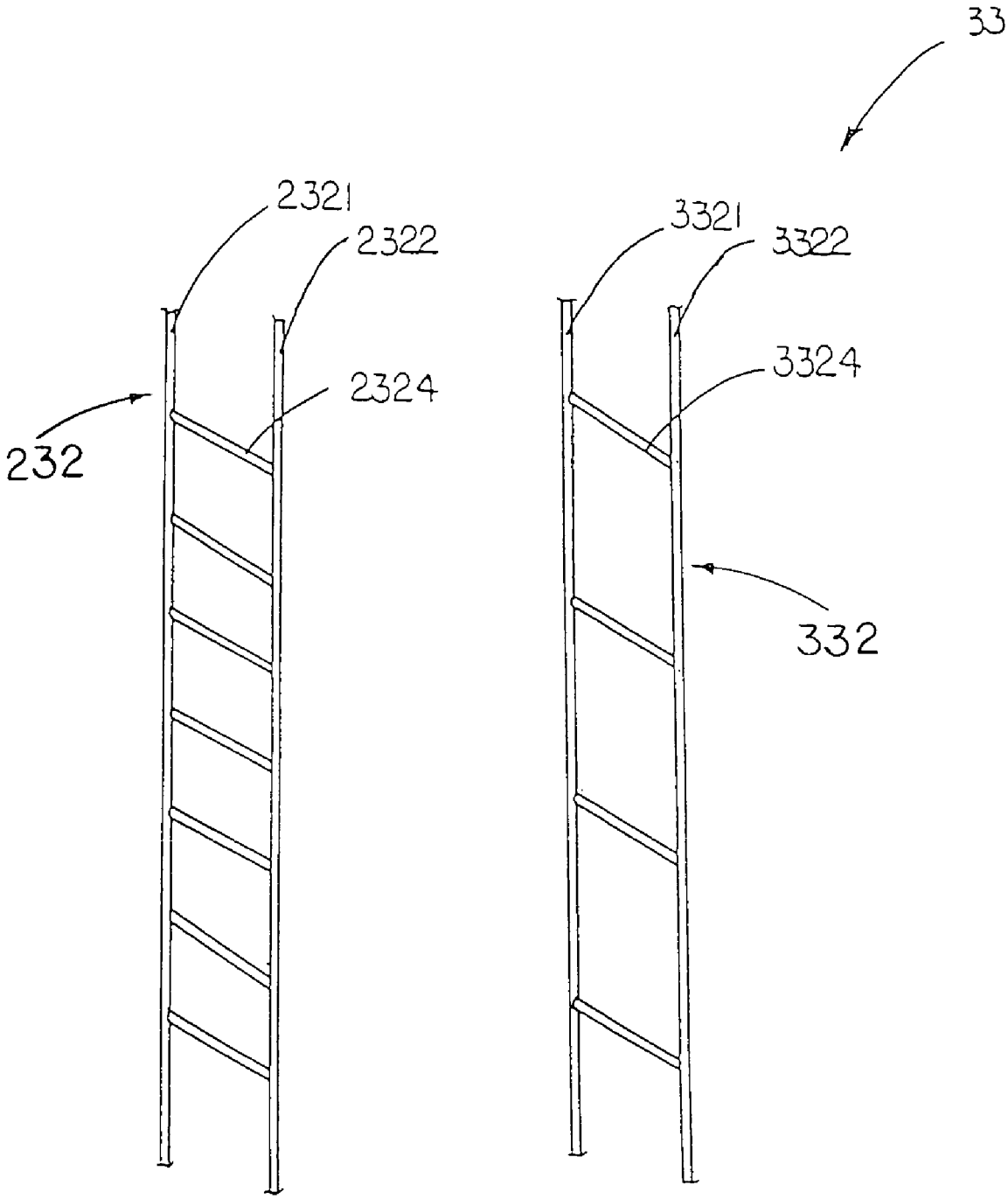
FIG. 6 is a perspective view of the window blind system according to the above preferred embodiment of the present invention, showing the comparison between the first hanging system and the second hanging system.

As described before, the first shading arrangement 20 is just embodied as a conventional window blind. So, the appearance and the function of the window blind of the present invention shows no difference compared with conventional window blind. Sunlight is allowed through the window blind from a normal gap which is the distance between adjacent traverse cords 2324 as shown in FIG. 4. However, since the length of the second hanging grids 3325 (i.e. the distance between adjacent traverse strings 3324) are at least twice the length of the first hanging grids 2325 (the distance between adjacent traverse cords 2324) in the preferred embodiment, the lifted second hanging system 33 will displace half of slats 22 supported by second hanging net 332 upward to overlap with another half of slats 22. Finally, sunlight will be allowed through the window blind from a gap which is the distance between adjacent traverse strings 3324 as shown in FIG. 5. Thereby, the window blind in the present invention provides a function by which a user is able to choose desirable sunlight intensity through the window blind.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A window blind system, comprising:

a top traverse supporter;

a first shading arrangement, which is downwardly extended from said top traverse supporter, comprising a base member, a plurality of slats, a first hanging system which is adapted for spacedly and suspendedly supporting said slats horizontally disposed between said top traverse supporter and said base member and for selectively rotating an angle of said slats, and a first operating system for selectively lifting up said base member towards said top traverse supporter and unlifting said base member to drop downwardly away from said top traverse supporter;

wherein said first shading arrangement comprises a traverse arm rotatably mounted to said top traverse supporter, at least two elongated hanging nets vertically extended from two ends of said traverse arm for suspendedly supporting said slats and said base member, wherein each of said elongated hanging net comprises a first and second supporting cords extended from two ends of said traverse arm to said base member, and a plurality of traverse cords spacedly extended between said two supporting cords to form a plurality of vertically and consecutively arranged first hanging grids, wherein said slats are positioned between said two supporting cords and separated by said first hanging grids;

wherein said first operating system comprises a lift lock rotatably mounted on said top traverse supporter and a lift cord having an end fastened to said base member, and another end upwardly extended to penetrate through said slats to reach said top traverse supporter, wherein said lift cord is exited from said top traverse supporter via said lift lock to control a folding process of said first shading arrangement; and a second shading arrangement, which is downwardly extended from said top traverse supporter, comprising a second hanging system which is adapted for spacedly and suspendedly supporting a predetermined set of said slats horizontally disposed between said top traverse supporter and said base member, and a second operating system for lifting up said second hanging system towards said top traverse supporter and unlifting said second hanging system to drop downwardly away from said top traverse supporter, so that by operating said second operation system, said predetermined set of said slats are capable of being lifted with respect to remaining said slats thus creating a varying shading status;

wherein said shading arrangement comprises at least two elongated second hanging nets vertically extended from two ends of said traverse arm to said base member for supporting said predetermined set of said slats, wherein each of said second hanging nets comprises a pair of elongated strings, and a plurality of traverse strings spacedly extended between said pair of elongated strings to form a plurality of vertically and consecutively arranged second hanging grids for supporting said predetermined set of said slats.

2. The window blind system, as recited in claim 1, wherein a distance between each two said transverse cords is at least lesser than a width of said slat.

3. The window blind system, as recited in claim 1, wherein said a distance between each two said transverse cords is at least larger than a distance of said transverse cord.

4. The window blind system, as recited in claim 2, wherein said a distance between each two said transverse cords is at least larger than a distance of said transverse cord.

5. The window blind system, as recited in claim 1, wherein a distance between each two said transverse strings is at least twice as a distance between each two said transverse cords.

6. The window blind system, as recited in claim 4, wherein a distance between each two said transverse strings is at least twice as said distance between each two said transverse cords.

7. The window blind system, as recited in claim 4, wherein said predetermined set of said slats supported by said second shading arrangement and remaining said slats supported by said first shading arrangement are vertically disposed between said top transverse supporter and said base member in an alternating manner, every two adjacent said slats are supported by respective said shading arrangement, so that sunshine is penetrated through a slat gap between every two slats, whenever said second operating system is pulled, said predetermined set of said slats are shifted to overlap with adjacent said slats thus enabling sunshine being penetrated through a distance twice as said slat gap.

8. The window blind system, as recited in claim 5, wherein said predetermined set of said slats supported by said second shading arrangement and remaining said slats supported by said first shading arrangement are vertically disposed between said top transverse supporter and said base member in an alternating manner, every two adjacent said slats are supported by respective said shading arrangement, so that sunshine is penetrated through a slat gap between every two slats, whenever said second operating system is pulled, said predetermined set of said slats are shifted to overlap with adjacent said slats thus enabling sunshine being penetrated through a distance twice as said slat gap.

9. The window blind system, as recited in claim 6, wherein said predetermined set of said slats supported by said second shading arrangement and remaining said slats supported by said first shading arrangement are vertically disposed between said top transverse supporter and said base member in an alternating manner, every two adjacent said slats are supported by respective said shading arrangement, so that sunshine is penetrated through a slat gap between every two slats, whenever said second operating system is pulled, said predetermined set of said slats are shifted to overlap with adjacent said slats thus enabling sunshine being penetrated through a distance twice as said slat gap.

10. The window blind system, as recited in claim 1, wherein said second operating system comprises a second lift cord having an end coupled to said elongated strings, and another end fastened to a locking device, wherein said locking device comprises an actuator which is adapted to shift said lift cord so as to vertically moving said second shading net to define said varying shading effect, said locking device are operated by driving means selected from a group consisting of manually operated driving device and electrically operated driving device.

* * * * *